US009303892B2

(12) United States Patent
Heim et al.

(10) Patent No.: US 9,303,892 B2
(45) Date of Patent: Apr. 5, 2016

(54) INFLATABLE AIR DUCTS WITH LOW HEIGHT-TO-WIDTH RATIOS

(71) Applicants: Frank Heim, Platteville, WI (US); Kevin J. Gebke, Dubuque, IA (US); Michael A. Jacobson, Dubuque, IA (US)

(72) Inventors: Frank Heim, Platteville, WI (US); Kevin J. Gebke, Dubuque, IA (US); Michael A. Jacobson, Dubuque, IA (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 193 days.

(21) Appl. No.: 14/151,417

(22) Filed: Jan. 9, 2014

(65) Prior Publication Data

US 2015/0192318 A1 Jul. 9, 2015

(51) Int. Cl.
*F16L 3/00* (2006.01)
*F24F 13/02* (2006.01)

(52) U.S. Cl.
CPC ..... *F24F 13/0218* (2013.01); *F24F 13/0254* (2013.01)

(58) Field of Classification Search
CPC ... E21F 17/02; F24F 13/0218; F24F 13/0254; F16L 3/00
USPC ..... 138/106, 107, 118; 248/61; 454/277, 454/338, 339, 334
See application file for complete search history.

(56) References Cited

U.S. PATENT DOCUMENTS 1,833,704 A * 11/1931 Bins ..... E21F 1/04 138/107
1,838,623 A 12/1931 Hersey, Jr. et al.
2,091,265 A 8/1937 Brown
2,222,497 A * 11/1940 Bins ..... E21F 17/02 138/107
3,357,088 A * 12/1967 Hoffman ..... A01G 9/18 138/107
3,520,244 A * 7/1970 Gaines, Jr. ..... F16L 3/00 138/107
5,094,273 A * 3/1992 Eagleton ..... E21F 1/04 138/103
5,137,057 A 8/1992 Hummert, III
6,280,320 B1 * 8/2001 Paschke ..... F24F 13/0218 454/296
6,425,417 B1 * 7/2002 Paschke ..... F24F 13/0218 138/106
8,434,526 B1 5/2013 Pinkalla et al.
2008/0113610 A1 * 5/2008 Brown ..... F24F 13/0254 454/339
2011/0000569 A1 * 1/2011 Lynch ..... F16L 11/10 138/107
2013/0220469 A1 * 8/2013 Fleagle ..... F24F 13/0218 138/107
2013/0233434 A1 9/2013 Adams et al.

OTHER PUBLICATIONS

Prihoda, "Fabric Ducting & Diffusers", www.prihoda.com/us, Jan. 2014, 32 pages.

* cited by examiner

*Primary Examiner* — Patrick F Brinson
(74) *Attorney, Agent, or Firm* — Hanley, Flight and Zimmerman, LLC

(57) ABSTRACT

Inflatable air ducts with low height-to-width ratios are disclosed. An example air duct system includes a top sheet, a bottom sheet, a first side sheet, and a second side sheet spaced apart from the first side sheet and extending between the top sheet and the bottom sheet. The top, bottom, first side, and second side sheets provide an inflatable air duct having an inflated state and a deflated state. The inflatable air duct has an inflated length greater than an inflated width. The inflated width is more than twice as great as an inflated height. The interior of the inflatable air duct defining an air passageway having a first airway, a second airway, and an intermediate airway. The intermediate airway is adjacent the first airway at a first transition area. The example air duct system also includes a second transition area between the intermediate airway and the second airway.

20 Claims, 5 Drawing Sheets

INFLATABLE AIR DUCTS WITH LOW HEIGHT-TO-WIDTH RATIOS

FIELD OF THE DISCLOSURE

The present disclosure relates generally to air ducts for HVAC systems (Heating Ventilating and Air Conditioning systems) and more specifically to inflatable air ducts with low height-to-width ratios.

BACKGROUND

Ductwork is often used for conveying conditioned air (e.g., heated, cooled, filtered, etc.) to or from a room or other areas within a building. Conventional ducts are made of sheet metal and have a substantially fixed internal volume regardless of whether the duct is conveying supply air to a room or return air from the room.

Sheet metal ducts are often installed above suspended ceilings for convenience; however, in warehouses, manufacturing plants and other industrial installations, it can be more practical and less expensive to install the ductwork underneath the ceiling. Sheet metal ducts underneath a ceiling, however, can create problems in those installation sites where prevention of air-borne contamination of inventory or other items is critical.

For instance, temperature variations in the building or temperature differentials between the ducts and the air being conveyed can create condensation on the interior or exterior of the ducts. The presence of condensed moisture on the interior of the duct may form mold or bacteria that the duct then passes onto the room or other areas being supplied with the conditioned air. In the case of exposed ducts, condensation on the exterior of the duct can drip onto the inventory or personnel below. The consequences of the dripping can range anywhere from a minor irritation to a dangerously slippery floor or complete destruction of products underneath the duct (particularly in food-processing facilities).

Further, metal ducts with localized discharge registers have been known to create uncomfortable drafts and unbalanced localized heating or cooling within the building. In many food-processing facilities where the target temperature is 42 degrees Fahrenheit, a cold draft can be especially uncomfortable and perhaps unhealthy.

Many of the above problems associated with metal ducts are overcome by the use of inflatable fabric ducts, such as DUCTSOX from DuctSox Corporation of Peosta and Dubuque, Iowa. Inflatable ducts typically have a pliable fabric wall (sometimes porous) that inflates to a generally cylindrical shape by the pressure of the air being conveyed within the duct. Fabric ducts seem to inhibit the formation of condensation on its exterior wall, possibly due to the fabric having a lower thermal conductivity than that of metal ducts. In addition, fabric porosity and/or additional holes distributed along the length of the fabric duct broadly and evenly disperse the air into the room being conditioned or ventilated. The even distribution of airflow also effectively ventilates the walls of the duct itself, thereby further inhibiting the formation of mold and bacteria.

DETAILED DESCRIPTION

Example air duct systems disclosed herein comprise an inflatable air duct that is extra wide to contain multiple side-by-side airways, including at least one intermediate airway between two other airways. The air duct systems are particularly suited for conveying air in HVAC systems (Heating Ventilating and Air Conditioning systems). A novel arrangement of internal restraints, external hangers and an overhead support system increase (e.g., maximize) the vertical clearance underneath the duct, regardless of whether the duct is inflated or deflated. In some examples, the overhead support system is a rectangular array of both lengthwise and crosswise supports. In some examples, the external hangers are of different vertical lengths. Some examples include an inflatable manifold. Some example ducts provide an airflow path that is non-linear (e.g., varies in elevation and/or in lateral direction).

Figure 1:
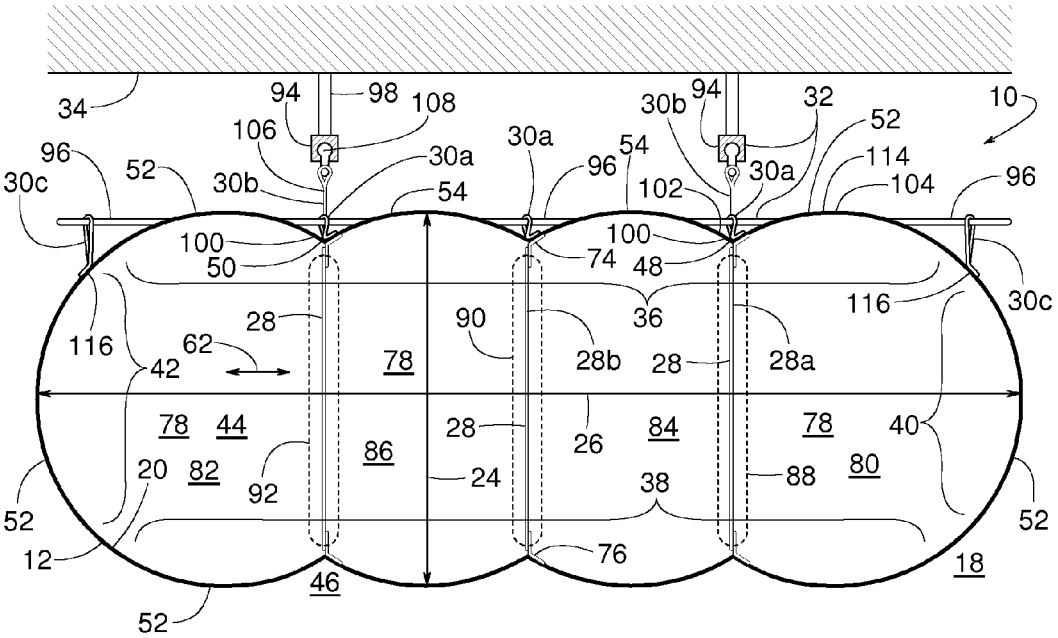
FIG. 1 is an open end view of an example air duct system constructed in accordance with the teachings disclosed herein, wherein the duct is in an inflated state.
Figure 2:
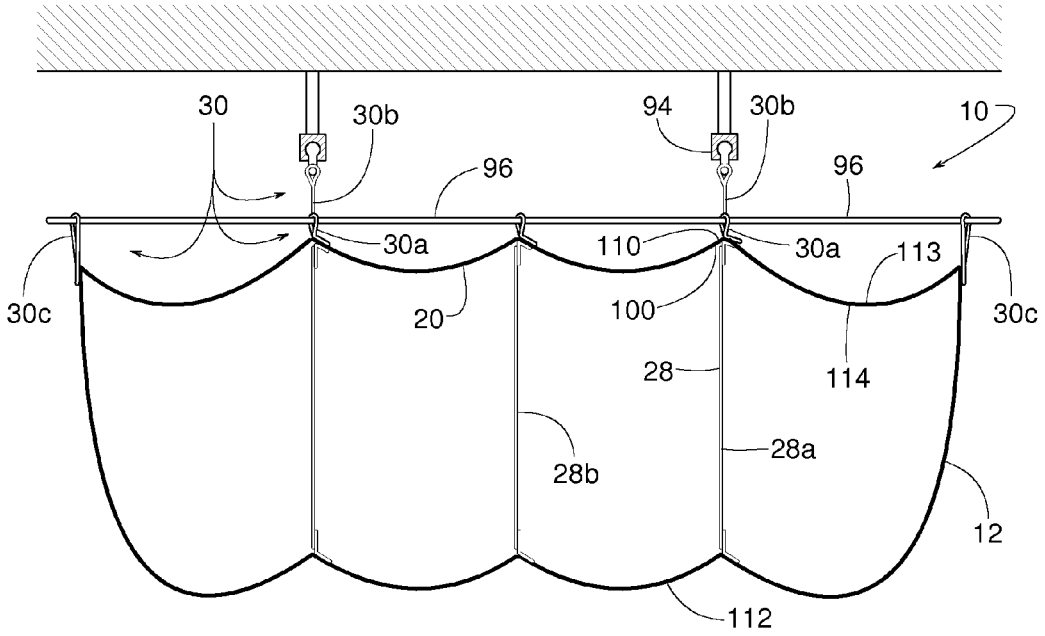
FIG. 2 is an open end view similar to FIG. 1 but showing the duct in a deflated state.
Figure 3:
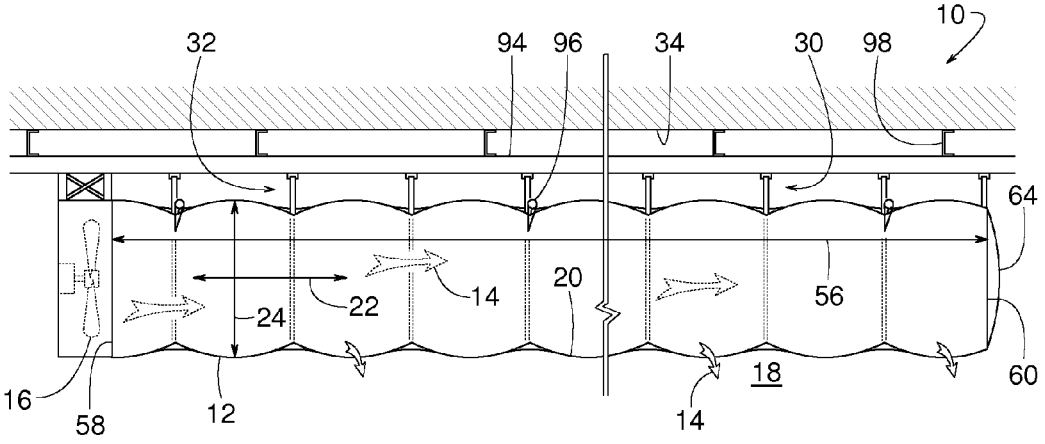
FIG. 3 is a side view of the inflated air duct system shown in FIG. 1.
Figure 4:
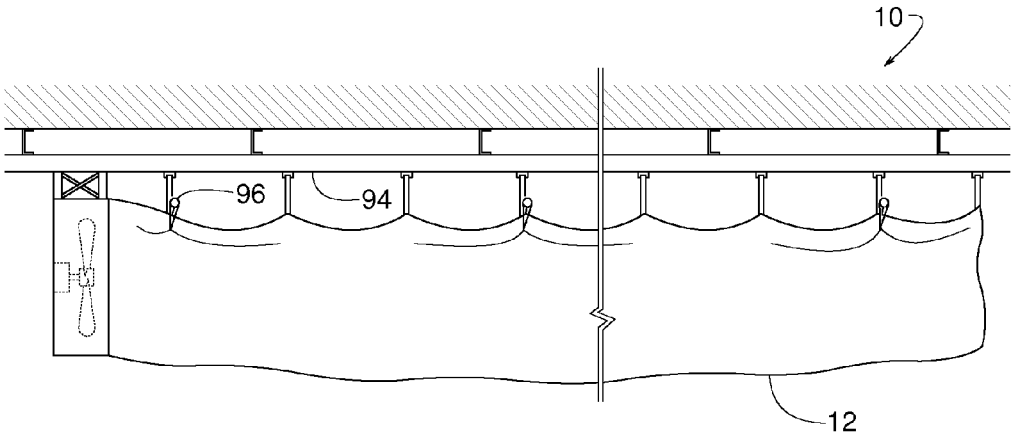
FIG. 4 is a side view of the deflated air duct system shown in FIG. 2.

FIGS. 1-4 show an example air duct system 10 comprising an inflatable air duct 12 for conveying air 14 discharged by a blower 16 (or some other source of forced air). Uses of the system 10 include, but are not limited to, heating, ventilating and air conditioning a certain area 18. The blower 16 can be selectively energized as needed. When energized, the blower's discharge air pressure expands a pliable wall 20 of the duct 12 to an inflated state, as shown in FIGS. 1 and 3. The expanded shape and larger volume promotes the flow of the air 14 in a generally longitudinal direction 22 from the blower 16 through the duct 12. While the duct 12 is in the inflated state, porosity or other openings in the wall 20 can release a desired amount of the air 14 to the area 18. After satisfying the area's need or demand for the air 14, de-energizing the blower 16 deflates the duct 12 to a deflated state, as shown in FIGS. 2 and 4.

Referring to FIG. 1, the duct 12 has an inflated vertical height 24 or thickness that is appreciably less than its inflated width 26. In the illustrated example, the width 26 is more than twice as great as the height 24. This provides the duct 12 with a relatively thin profile that makes the system 10 particularly suited for use in areas with low ceiling clearance. To maintain a thin profile in the deflated state, some examples of the duct 12 include internal restraints 28 (e.g., a first restraint 28*a* and a second restraint 28*b*) and are suspended by hangers 30 from a broad overhead support system 32 that is mounted to a ceiling 34 of the area 18. The actual structure of the support system 32, the hangers 30, the inflatable duct 12 and its internal restraints 28 may vary.

In some examples, the pliable wall 20 of the duct 12 comprises a top sheet 36, a bottom sheet 38, a first side sheet 40 and a second side sheet 42. The pliable wall 20 is what divides an interior 44 from an exterior 46 of the duct 12. A combination of the sheets 36, 38, 40, 42, in some examples, is one continuous sheet of material. In some examples, the pliable wall 20 includes one or more seams. In some examples, the pliable wall 20 has a first seam 48 and a second seam 50 along the top sheet 36, whereby a relatively large sheet section 52 encompasses the bottom sheet 38, the side sheets 40, 42, and parts of the top sheet 36; and a much smaller sheet section 54 extends partially across the top sheet 36 between the seams 48, 50.

Example materials of the pliable wall 20 include, but are not limited to, vinyl, polyester sheeting, and polyester fabric. Some example materials are perforated, porous, impervious to gas, or are combinations thereof (e.g., some porous areas and some areas impervious to gas). Some example materials are impregnated or coated with a sealant, such as acrylic or polyurethane. Some example materials are uncoated. Some example materials are fire or heat resistant.

FIG. 3 shows the duct 12 having an inflated length 56 extending in the longitudinal direction 22 between a first end 58 and a second end 60. The inflated width 26 extends in a lateral direction 62, perpendicular to the longitudinal direction 22. And the inflated height 24 extends perpendicular to the longitudinal direction 22 and the lateral direction 62. In the illustrated example, an end cap 64 of a material similar to that of the pliable wall 20 is zippered, sewn or otherwise attached to the duct's second end 60, and the blower 16 is attached to the first end 58. In other examples, the location of the blower 16 and the end cap 64 is reversed with respect to the ends 58, 60.

Figure 5:
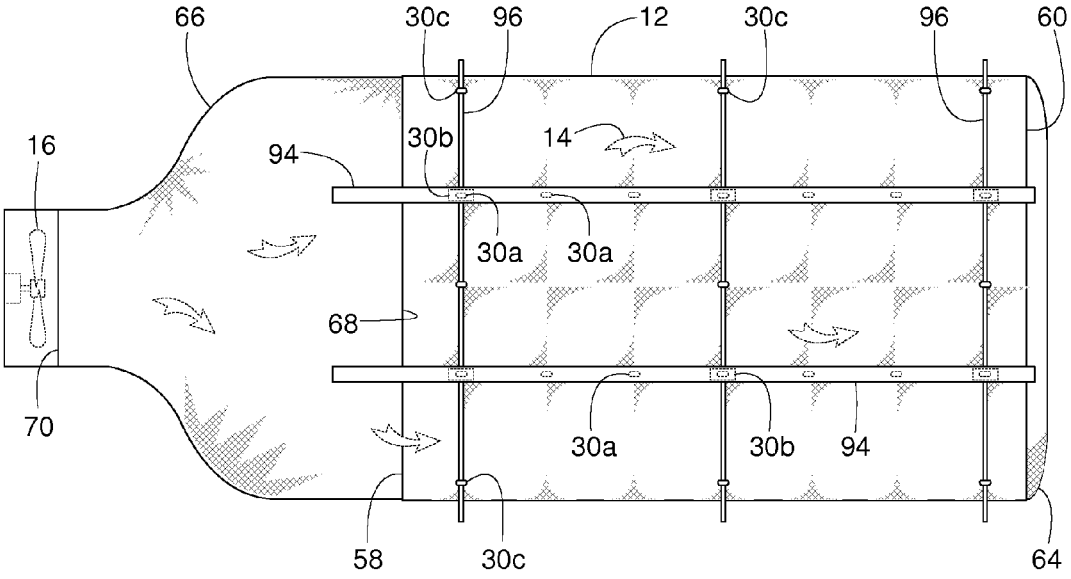
FIG. 5 is a top view of an example air duct system similar to that of FIGS. 1-4 but including an example manifold constructed in accordance with the teachings disclosed herein.

In some examples, as shown in FIG. 5, an inflatable, pliable-wall manifold 66 or other suitable adaptor connects the blower 16 to the first end 58. In addition or alternatively, the inflatable manifold 66 is connected to the second end 60, downstream of the duct 12. In some examples, the inflatable manifold 66 has a first opening 68 with a perimeter that is at least forty percent larger than a perimeter of the manifold's second opening 70. The size difference of the openings 68, 70 allows a single-airway duct to distribute its airflow evenly across a multi-airway duct, or vice versa.

Figure 6:
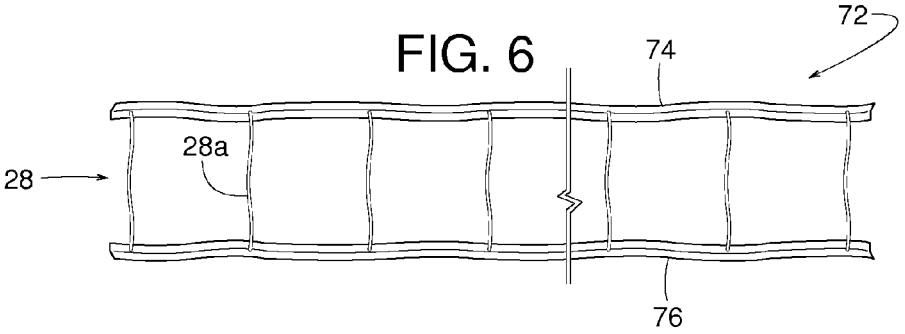
FIG. 6 is a side view of an example restraint system used in the air duct systems shown in FIGS. 1-5 and constructed in accordance with the teachings disclosed herein.

To help maintain the shape of the duct 12, some examples of the internal restraints 28, as shown in FIG. 6, are part of a sewn-together assembly 72 comprising an upper fabric strip 74, a lower fabric strip 76 and the plurality of restraints 28 extending between the strips 74, 76. In some examples, the restraints 28 are ropes each with their opposite ends sewn or otherwise connected to the strips 74, 76. Other examples of the restraints 28 include, but are not limited to, ribbons, cables, wires, chains, straps, elastic chords (of limited elastic length), fabric strips, rigid rods, and rigid bars. In some examples, the upper strip 74 is sewn or otherwise attached to the top sheet 36, and the lower strip 76 is sewn or otherwise attached to the bottom sheet 38. In some example alternatives, the first restraint 28*a* and the second restraint 28*b* are each continuous sheets of material having a total height and total length approximately equal to the duct's inflated length 56 and the inflated height 24. Examples of such continuous sheets of material include, but are not limited to, porous fabric, impervious fabric, plastic sheeting, netting, and elastic fabric (of limited elastic expansion).

The restraints 28 help determine the shape of the duct 12 in the duct's inflated and deflated states. In the inflated state, as shown in FIG. 1, the duct's interior 44 provides an air passageway 78 extending longitudinally along the longitudinal direction 22 while being defined vertically between the top sheet 36 and the bottom sheet 38, and being defined laterally between the side sheets 40, 42. The passageway 78 includes a first airway 80 along the first side sheet 40, a second airway 82 along the second side sheet 42, and at least one intermediate airway 84 somewhere between the first and second airways 80, 82. The illustrated example happens to have two intermediate airways 84, 86; however, the duct 12 can have any number of intermediate airways between the first and second airways 80, 82. In the illustrated example, a first transition area 88 is between the first airway 80 and the first intermediate airway 84, a second transition area 90 is between the intermediate airways 84, 86, and a third transition area 92 is between the second intermediate airway 86 and the second airway 82. The locations of the restraints 28 establish the locations of the transition areas 88, 90, 92 and provide strategic points from which to suspend the duct 12 from the overhead support system 32.

In the illustrated example, the overhead support system 32 comprises at least one or a plurality of lengthwise supports 94 and at least one or a plurality of crosswise supports 96. The lengthwise supports 94 are elongate in the longitudinal direction 22, and the crosswise supports 96 are elongate in the lateral direction 62. The phrase, "crosswise support being elongate in a lateral direction perpendicular to the longitudinal direction," means that opposite ends of the crosswise support are spaced farther apart in the lateral direction than in the longitudinal direction, so the crosswise support does not necessarily lie perpendicular to the longitudinal direction, but rather the crosswise support is closer to lying perpendicular to the longitudinal direction than parallel to it.

Examples of the lengthwise supports 94 include, but are not limited to, a rail, a beam, a bar, a track, a pipe, a tube, an extrusion, a ceiling of a building, a building rafter, a building truss, a ceiling joist, and a taut cable. In some examples, the lengthwise support 94 is an aluminum extruded track, and any suitable mounting hardware 98 connects the lengthwise support 94 to the ceiling 34 (e.g., the ceiling of a building, underground mine, tunnel, etc.). Examples of the crosswise supports 96 include, but are not limited to, a rod, a beam, a rail, a bar, a track, a pipe, a tube, and an extrusion. In some examples, the crosswise support 96 is a fiberglass rod.

In some examples, the lengthwise supports 94 have an extruded lateral cross-sectional profile that makes them stiffer than the crosswise supports 96. In some examples, the lengthwise supports 94 are cables that are more flexible than the crosswise supports 96; however, cable-style lengthwise supports held in tension can provide the desired support to carry the weight of the duct 12. In some examples, the lengthwise supports 94 carry more suspended weight than do the crosswise supports 96.

The hangers 30, which suspend the duct 12 from the overhead support 32, are vertically elongate members. Examples of the hangers 30 include, but are not limited to, rope (e.g., a transition hanger 30*a*), straps (e.g., transition hangers 30*b* and side hanger 30*c*), ribbons, cables, wires, chains, elastic chords (of limited elastic length), fabric strips, rigid rods, and rigid bars.

To increase (e.g., maximize) the vertical clearance underneath the duct 12 in both its inflated and deflated states, the hangers 30 are at certain locations and are of different vertical lengths. In some examples, each of the transition hangers 30*b*, for instance, is sewn or otherwise attached to a point 100 on an inflated valley 102 of the inflated duct 12, just above the transition area 88. This allows an inflated peak 104 of the inflated duct 12 to be higher than the hanger-to-duct point of attachment 100. In some examples, an upper end 106 of the hanger 30*b* attaches to a connector 108 on the lengthwise support 94. In some such examples, when the duct 12 is in its deflated state, as shown in FIG. 2, the attachment point 100 becomes a deflated peak 110 that is higher than a deflated valley 113 of the top sheet 36. This maintains the lower portions 112 of the bottom sheet 38 at a substantially constant elevation, regardless of whether the duct 12 is inflated or deflated.

To provide the duct 12 with vertical support across the duct's width, the hangers 30*a*, 30*c* connect certain points of the duct 12 to the crosswise support 96. Each transition hanger 30*a*, for instance, is connected to a point (e.g., the point 100) directly above each restraint 28, thereby supporting the duct 12 at the transition areas 88, 90, 92. In some examples, the transition hangers 30*a* are ropes sewn to the duct 12 and loop over the crosswise support 96. In the illustrated example, the transition hangers 30*a* are appreciably shorter than the transition hangers 30*b* so that when the duct 12 is inflated, portions of the top sheet 36 bulge above the crosswise support 96. More specifically, the top sheet 36 includes a movable section 114 having selectively a sagging position (FIG. 2) and a bulging position (FIG. 1), wherein the movable section 114 in the sagging position is lower than the crosswise support 96, and the movable section 114 in the bulging position is higher than the crosswise support 96. Providing the duct 12 with portions that can bulge above its supporting structure, and particularly above the duct's points of attachment (e.g., the point 100), advantageously increases the vertical clearance underneath the duct 12.

Figure 7:
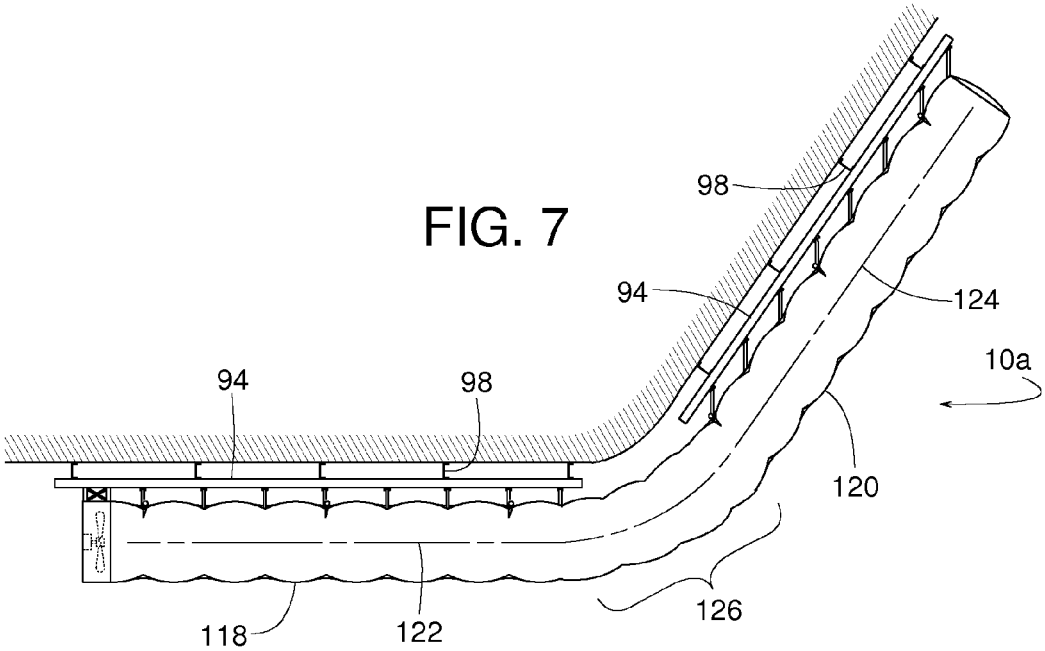
FIG. 7 is a side view of another example air duct system constructed in accordance with the teachings disclosed herein.
Figure 8:
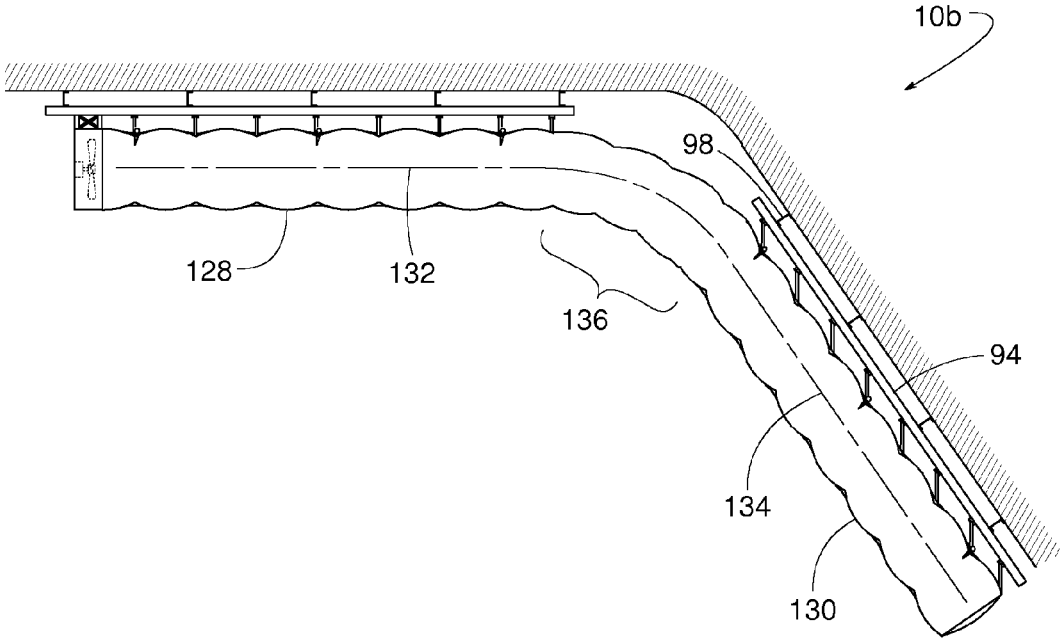
FIG. 8 is a side view of yet another example air duct system constructed in accordance with the teachings disclosed herein.

To reduce (e g, minimize) sagging of the side sheets 40, 42 when the duct 12 is deflated, in some examples, each side hanger 30*c* loops over the crosswise support 96 and is sewn or otherwise attached to the duct 12 at a point 116 proximate the first side sheet 40 or the second side sheet 42. At this location, the inflated peak 104 is laterally situated between the side hanger 30*c* and the transition hanger 30*a*. The side hanger 30*c* is appreciably longer than the transition hanger 30*a* because the point 116 is lower than the point 100 while both the hangers 30*a*, 30*c* connect to the same crosswise support 96. The illustrated example maintains the duct's upper points of attachment (e.g., the points 100, 116) at a substantially fixed height so that the restraints 28 can suspend the bottom sheet 38 at a generally constant elevation regardless of whether the duct 12 is inflated or deflated. Although the crosswise supports 96 of the illustrated example might flex, the support system 32 overall provides the duct 12 with significant vertical stability. FIG. 7 shows an example air duct system 10*a* that extends or curves upward, and FIG. 8 shows an example air duct system 10*b* that extends or curves downward. In other examples, the ducts are horizontally angled or curved left or right. Referring to FIG. 7, the air duct system 10*a* comprises a first inflatable air duct section 118 and a second inflatable air duct section 120 that are connected in serial communication with each other. The air duct sections 118, 120 are similar in construction to the inflatable air duct 10 with respect to the duct's width, height, length, air passageway, airways, transition areas, inflated state, deflated state, internal restraints, top sheet, bottom sheet, side sheets, valleys, peaks, etc.

The air passageway of the first duct section 118 defines a first longitudinal centerline 122, and the air passageway of the second duct section 120 defines a second longitudinal centerline 124. The longitudinal centerlines 122, 124 are displaced out of collinear alignment, either angularly and/or curved. FIG. 7, for example, shows some sections of the centerlines 122, 124 that are linear but not parallel. FIG. 7 also shows a central section 126 of the centerlines 122, 124 that is curved, with the centerline 124 curving upward.

Referring to FIG. 8, the air duct system 10*b* comprises a first inflatable air duct section 128 and a second inflatable air duct section 130 that are connected in serial communication with each other. The air duct sections 128, 130 are similar in construction to the inflatable air duct 10 with respect to the duct's width, height, length, air passageway, airways, inflated state, deflated state, etc.

The air passageway of the first duct section 128 defines a first longitudinal centerline 132, and the air passageway of the second duct section 130 defines a second longitudinal centerline 134. The longitudinal centerlines 132, 134 are displaced out of collinear alignment, either angularly and/or curved. FIG. 8, for example, shows some sections of the centerlines 132, 134 that are linear but not parallel. FIG. 8 also shows a central section 136 of the centerlines 132, 134 that is curved, with the centerline 134 curving downward.

Figure 9:
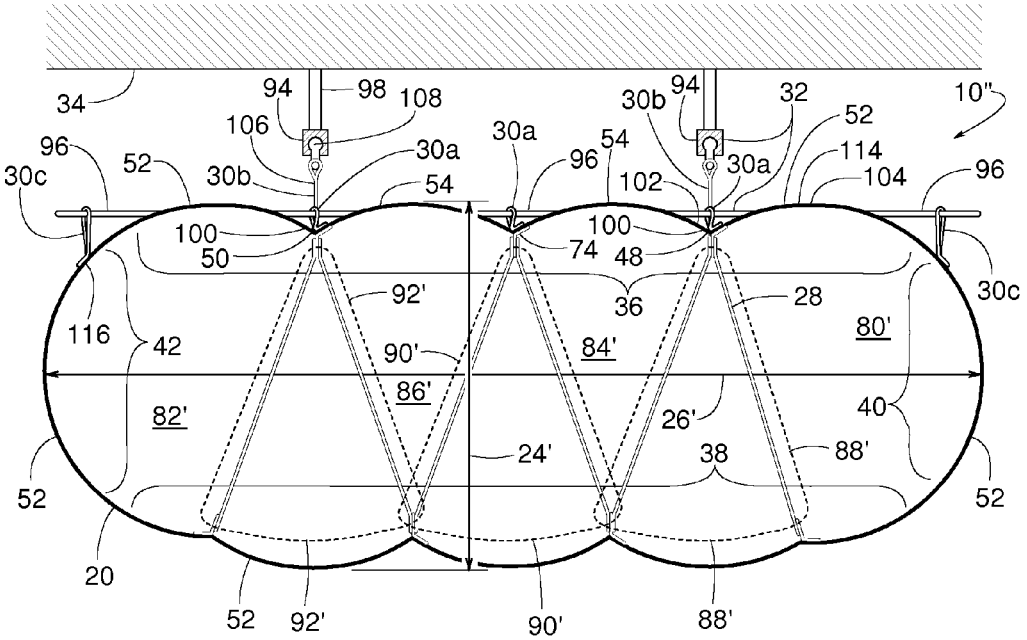
FIG. 9 is an open end view of another example air duct system constructed in accordance with the teachings disclosed herein, wherein the duct is in an inflated state.
Figure 10:
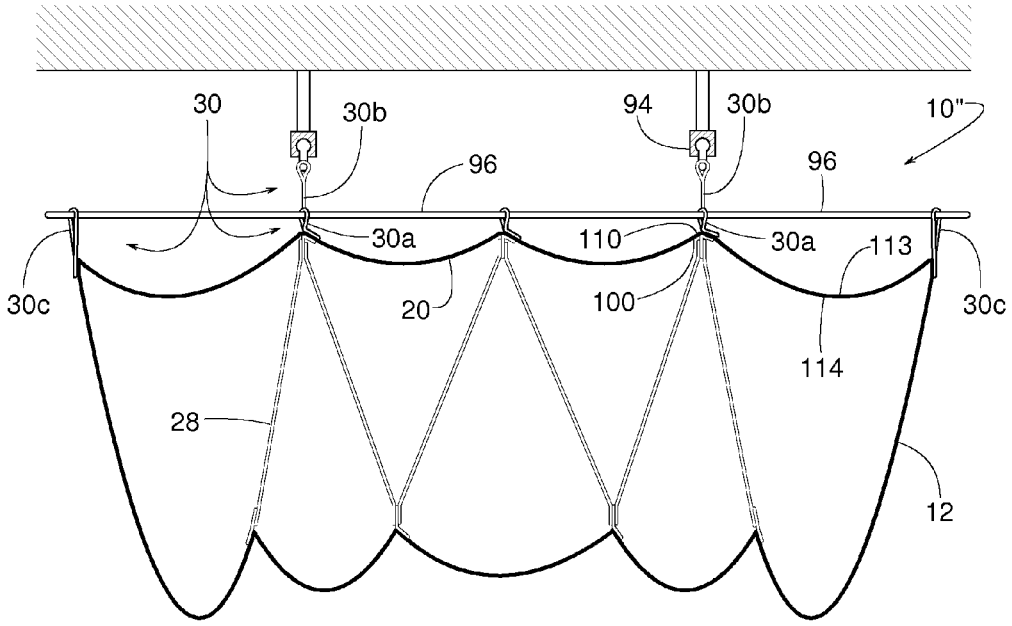
FIG. 10 is an open end view similar to FIG. 9 but showing the duct in a deflated state.

FIGS. 9 and 10 show an example air duct system 10" in an inflated state and a deflated state, respectively, that is similar to the duct system 10 of FIGS. 1 and 2. However, unlike FIGS. 1 and 2, the duct system 10" of FIGS. 9 and 10 has its restraints 28 in a different arrangement to create some airways and/or transition areas that are generally triangular. For example, the airways 84', 86' and the transition areas 88', 90', 92' are generally triangular. Moreover, in some examples, the transition areas 88', 90', 92' further serve as airways as well. The air duct system 10" includes airways 80' and 82', which are adjacent to the first and second side sheets 40, 42, respectively. In this example, the air duct system 10" has an inflated width 26' that is more than twice as great as its inflated height 24'.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

What is claimed is:

1. An air duct system, comprising:

an overhead support system including a plurality of lengthwise supports and a crosswise support, the plurality of lengthwise supports being elongate in a longitudinal direction, the crosswise support being elongate in a lateral direction perpendicular to the longitudinal direction; and an inflatable air duct supported by both the lengthwise supports and the crosswise support, the inflatable air duct having an inflated state and a deflated state, the inflatable air duct having an exterior and an interior with the interior defining an air passageway that is elongate in the longitudinal direction, the inflatable air duct having an inflated length extending in the longitudinal direction, an inflated width extending in the lateral direction perpendicular to the longitudinal direction, and an inflated height extending perpendicular to both the longitudinal direction and the lateral direction, the inflated length being greater than the inflated width, and the inflated width being at least two times greater than the inflated height.

2. The air duct system of claim 1, further including:

a first hanger to hold the inflatable air duct in suspension from a first one of the plurality of lengthwise supports;

a second hanger to hold the inflatable air duct in suspension from the crosswise support;

the air passageway to have a first airway along a first lateral side of the air duct, a second airway along a second lateral side of the air duct opposite the first lateral side, and an intermediate airway between the first airway and the second airway; and an inflated valley defined by a top portion of the air duct, the inflated valley on the exterior of the inflatable air duct and overlying a transition area between the first airway and the intermediate airway, wherein at least one of the first hanger or the second hanger is to connect to the inflatable air duct at a point laterally between the inflated valley and the first lateral side of the air duct.

3. The air duct system of claim 1, further including a plurality of crosswise supports that includes the crosswise support, wherein the plurality of lengthwise supports are to carry more weight than do the plurality of crosswise supports.

4. The air duct system of claim 1, wherein both the lengthwise supports and the crosswise support are above the inflatable air duct in the deflated state.

5. The air duct system of claim 1, wherein the lengthwise supports and the crosswise support are distinguishable from each other with respect to their stiffness.

6. The air duct system of claim 1, wherein the lengthwise supports and the crosswise support are distinguishable from each other with respect to their cross-sectional profile.

7. The air duct system of claim 1, wherein the lengthwise supports are vertically offset relative to the crosswise support.

8. The air duct system of claim 1, wherein the inflatable air duct includes a top sheet, a bottom sheet underneath the top sheet, a first side extending between the top sheet and the bottom sheet, and a second side spaced apart from the first side and extending between the top sheet and the bottom sheet;

the air passageway being defined by the top sheet, the bottom sheet, the first side and the second side; the air passageway including a first airway, a second airway, an intermediate airway, a first transition area and a second transition area; the first airway being along the first side, the second airway being along the second side, the intermediate airway being between the first airway and the second airway, the first transition area being between the first airway and the intermediate airway, the second transition area being between the intermediate airway and the second airway; the air duct system further including:

a first restraint to connect the top sheet to the bottom sheet in the first transition area;

a second restraint to connect the top sheet to the bottom sheet in the second transition area;

an inflated valley defined by the top sheet, the inflated valley on the exterior of the inflatable air duct and overlying the first transition area when the inflatable air duct is in the inflated state;

an inflated peak defined by the top sheet, the inflated peak on the exterior of the inflatable air duct and overlying the intermediate airway when the inflatable air duct is in the inflated state;

a side hanger on the exterior of the inflatable air duct, the side hanger being proximate the first side of the inflatable air duct, the side hanger to connect the inflatable air duct to the overhead support system; and a transition hanger on the exterior of the inflatable air duct, the transition hanger being above and proximate the first transition area, the transition hanger to connect the inflatable air duct to the overhead support system, the inflated peak being laterally interposed between the side hanger and the transition hanger.

9. The air duct system of claim 1, further including a plurality of hangers that are vertically elongate, the plurality of hangers to connect the inflatable air duct to the overhead support system, the plurality of hangers being of different vertical lengths.

10. The air duct system of claim 1, wherein the inflatable air duct includes a movable section overlying the air passageway, the movable section having a sagging position and a bulging position, the movable section being in the sagging position when the inflatable air duct is in the deflated state, the movable section being in the bulging position when the inflatable air duct is in the inflated state, the movable section in the sagging position being lower than at least one of the lengthwise supports or the crosswise support, and the movable section in the bulging position being higher than at least one of the lengthwise supports or the crosswise support.

11. An air duct system, comprising:

a first inflatable air duct section having an inflated state and a deflated state, the first inflatable air duct section defining a first air passageway that is elongate along a first longitudinal centerline; the first inflatable air duct section having a first inflated length extending along the first longitudinal centerline, a first inflated width extending in a first lateral direction perpendicular to the first longitudinal centerline, and a first inflated thickness extending perpendicular to both the first longitudinal centerline and the first lateral direction, the first inflated length being greater than the first inflated width, and the first inflated width being at least twice greater than the first inflated thickness; and a second inflatable air duct section connected in fluid communication with the first inflatable air duct section, the second inflatable air duct section having the inflated state and the deflated state, the second inflatable air duct section defining a second air passageway that is elongate along a second longitudinal centerline; the second inflatable air duct section having a second inflated length extending along the second longitudinal centerline, a second inflated width extending in a second lateral direction perpendicular to the second longitudinal centerline, and a second inflated thickness extending substantially perpendicular to both the second longitudinal centerline and the second lateral direction, the second inflated length being greater than the second inflated width, the second inflated width being at least twice greater than a second inflated height, and the second longitudinal centerline being angularly displaced out of collinear alignment with the first longitudinal centerline such that the first and second longitudinal centerlines are not parallel.

12. The air duct system of claim 11, wherein the second longitudinal centerline is curved upward relative to the first longitudinal centerline.

13. The air duct system of claim 11, wherein the second longitudinal centerline is curved downward relative to the first longitudinal centerline.

14. The air duct system of claim 11, wherein both the first longitudinal centerline and the second longitudinal centerline are substantially linear and angularly displaced relative to each other.

15. The air duct system of claim 11, wherein the first inflatable air duct includes a top sheet, a bottom sheet underneath the top sheet, a first side sheet extending between the top sheet and the bottom sheet, and a second side sheet spaced apart from the first side and extending between the top sheet and the bottom sheet;

the first air passageway being defined by the top sheet, the bottom sheet, the first side sheet and the second side sheet; the first air passageway including a first airway, a second airway, an intermediate airway, a first transition area and a second transition area; the first airway being along the first side sheet, the second airway being along the second side sheet, the intermediate airway being between the first airway and the second airway, the first transition area being between the first airway and the intermediate airway, the second transition area being between the intermediate airway and the second airway; the air duct system further including:

a first restraint to connect the top sheet to the bottom sheet in the first transition area;

a second restraint to connect the top sheet to the bottom sheet in the second transition area;

an inflated valley defined by the top sheet, on an exterior of the first inflatable air duct, and overlying the first transition area when the first inflatable air duct is in the inflated state; and an inflated peak defined by the top sheet, on an exterior of the first inflatable air duct, and overlying the intermediate airway when the inflatable air duct is in the inflated state.

16. The air duct system of claim 11, further including:

a first lengthwise support being elongate in a first direction substantially parallel the first longitudinal centerline;

a first crosswise support being elongate in the first lateral direction;

a first hanger to hold the first inflatable air duct in suspension from the first lengthwise support; and a second hanger to hold the first inflatable air duct in suspension from the first crosswise support.

17. An air duct system for conveying a current of air, the air duct system comprising:

a top sheet;

a bottom sheet underneath the top sheet;

a first side sheet extending between the top sheet and the bottom sheet;

a second side sheet spaced apart from the first side sheet and extending between the top sheet and the bottom sheet; the top sheet, the bottom sheet, the first side sheet and the second side sheet providing an inflatable air duct having an inflated state and a deflated state, the inflatable air duct defining an interior and an exterior, the inflatable air duct having an inflated length extending in a longitudinal direction, an inflated width extending in a lateral direction perpendicular to the longitudinal direction, and an inflated height extending perpendicular to both the longitudinal direction and the lateral direction;

the inflated length extending between a first end and a second end of the inflatable air duct, the inflated length being greater than the inflated width, and the inflated width being more than twice as great as the inflated height;

an air passageway to convey the current of air in the longitudinal direction between the first end and the second end, the air passageway being within the interior of the inflatable air duct, the air passageway being defined by the top sheet, the bottom sheet, the first side sheet and the second side sheet, the air passageway being greater in volume when the inflatable air duct is in the inflated state than when the inflatable air duct is in the deflated state, the air passageway including a first airway along the first side sheet, a second airway along the second side sheet, and an intermediate airway between the first airway and the second airway, the intermediate airway being adjacent the first airway at a first transition area;

a first restraint to connect the top sheet to the bottom sheet in the first transition area;

a second restraint to connect the top sheet to the bottom sheet in a second transition area; and an inflatable manifold connected to the inflatable air duct, the inflatable manifold defining a first opening and a second opening, the first opening having a perimeter at least forty percent larger than that of the second opening, the first opening adjacent the first end of the inflatable air duct, thereby placing the inflatable manifold in fluid communication with the inflatable air duct.

18. The air duct system of claim 1, wherein the inflatable air duct includes an inflated valley on a top side of the inflatable air duct when the inflatable air duct is in the inflated state.

19. The air duct system of claim 1, further including a plurality of internal restraints to connect a top sheet of the inflatable air duct to a bottom sheet of the inflatable air duct.

20. The air duct system of claim 19, wherein a first one of the plurality of internal restraints is attached to a first point on at least one of the top sheet or the bottom sheet and a second one of the plurality of internal restraints is attached to a second point on the at least one of the top sheet or the bottom sheet, the first point being displaced relative to the second point in the lateral direction.

* * * * *